United States Patent [19]

McCullough

[11] 4,019,493

[45] Apr. 26, 1977

[54] GUARD FIXTURE FOR A FIREPLACE GRATE

[76] Inventor: Edward R. McCullough, 1219 Irving, Royal Oak, Mich. 48067

[22] Filed: Mar. 8, 1976

[21] Appl. No.: 665,048

[52] U.S. Cl. ..... 126/165; 126/336

[51] Int. Cl.[2] ..... F23H 13/02

[58] Field of Search ..... 126/165, 164, 154, 336, 126/152; D7/136

[56] References Cited

UNITED STATES PATENTS

| | | | |
|---|---|---|---|
| 300,059 | 6/1884 | Fisher | 126/164 |
| 742,210 | 10/1903 | Moreland | 126/336 |
| 2,578,564 | 12/1951 | Love et al. | 126/298 |
| 2,926,657 | 3/1960 | Ford | 126/165 |
| 2,985,165 | 5/1961 | Peterson et al. | 126/165 |
| 3,505,986 | 4/1970 | Wood | 126/165 |
| 3,612,034 | 10/1971 | Wood | 126/165 |

FOREIGN PATENTS OR APPLICATIONS

| | | | |
|---|---|---|---|
| 262,612 | 12/1926 | United Kingdom | 126/165 |
| 10,622 | 1/1914 | United Kingdom | 126/164 |

*Primary Examiner*—John J. Camby
*Assistant Examiner*—Larry I. Schwartz
*Attorney, Agent, or Firm*—Thomas N. Young

[57] ABSTRACT

A guard fixture is mountable on a fireplace grate of the type having a frame formed of a plurality of spaced rib members which extend fore and aft when the grate is placed in a fireplace opening. The guard fixture includes an elongate post which projects substantially vertically with respect to the grate frame. The post is mounted on the grate by a pair of flange plates, one of which is affixed to the bottom of the post. The flange plates are positioned on opposite sides of adjacent rib members, and are caused to be held thereagainst by a threaded bolt which passes between the adjacent rib members to mechanically couple the flange plates.

3 Claims, 5 Drawing Figures

GUARD FIXTURE FOR A FIREPLACE GRATE

INTRODUCTION

This invention relates to firepalce grates and particularly to a guard fixture mountable on a grate to keep logs from rolling from the grate.

BACKGROUND OF THE INVENTION

Nearly every wood burning fireplace is provided with a grate to facilitate combustion and to improve heating efficiency. Fireplace grates are functionally designed to receive and contain a limited quantity of firewood. It is not uncommon, however, for grates to be loaded beyond their intended capactiy by carefully balancing or positining extra logs upon those directly supported by the grate. Such a condition is extremely hazardous and conducive to allowing the wood to roll from the grate and cause a smoke-filled room, if not a complete conflagration.

The prior art has recoginzed this problem but has come forth with devices of limited design flexibility. Examplary of this point, is the patent to Merrilees U.S. Pat. NO. 3,612,034, which shows a fireplace grate with a set of upstanding prongs that are intended to retain logs within the grate. However, the prongs have their bottom ends mechanically formed such that they will engage only a grate having a frame formed of laterally extending rib members.

This leaves unsolved the problem of the popular basket-type and dish-type fireplace grates which have frames formed of spaced rib members extending fore and aft, in contrast to the laterally extending rib members of Merrilees, and which are in broad use today.

Thus, it is an objective of the present invention to provide an advance design which meets the log roll-out problem associated with the basket-type grate, the dish-type grate, and grates of similar construction. Other objectives, including simplicity, flexibility of use, ease of manufacture, and low cost, are additional considerations in the design of the present invention.

BRIEF SUMMARY OF THE INVENTION

According to the objectives of the invention, a guard fixture is mountable on any type of fireplace grate having a frame which is formed of a plurality of rib members which extend fore and aft. The guard fixture positively retains logs within the grate, yet does not interfere with the function.

Basically, the guard fixture includes an elongate post which projects substantially vertically from the forward portion of the grate to guard against accidental displacement of logs from the grate. The post has appended to its bottom end means for mounting it to the grate. In the preferred form of the invention, these means take the form of a flange plate which operates in combination with a similar, unaffixed plate. The flange plates are positoned on opposite surfaces of adjacent rib members and are caused to be held thereagainst by a threaded bolt which passes between the adjacent rib members to mechanically couple the flange plates.

With grates of various frame design, the posts may be altered in form as by bending, or the like, to bring them into substantial vertical orientation with respect to the frame. To illustrate this point, first and second embodiments of the invention with a basket-type grate and a dish-type grate, respectively, are hereinafter shown.

Additional advantages and modifications to the invention will be made apparent in the following description of a specific embodiment.

DETAILED DESCRIPTION OF THE SPECIFIC EMBODIMENT

Figure 1:
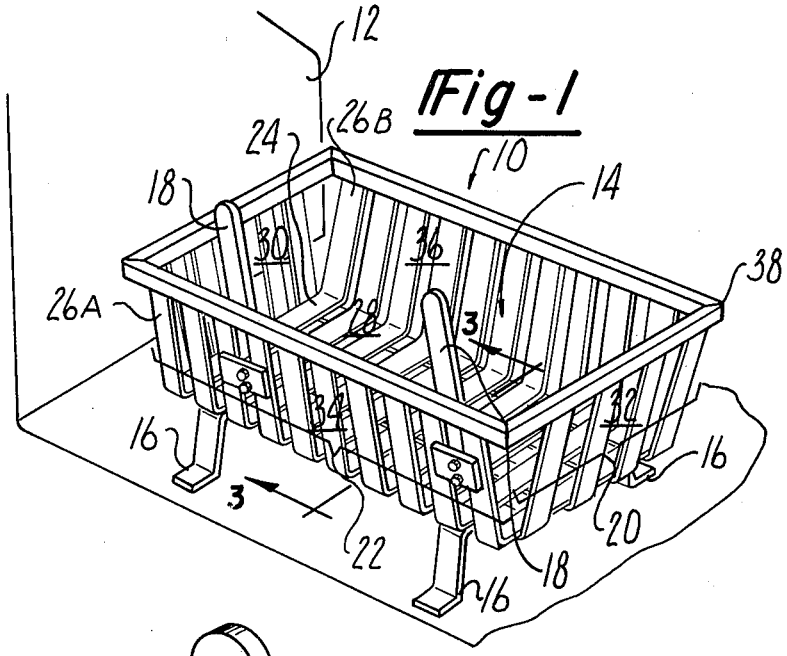
FIG. 1 is a perspective view of a basket-type fireplace grate equipped with the guard fixtures of the present invention.

With reference to FIG. 1, a basket-type fireplace grate shown generally at 10, is disposed within a fire chamber 12. The grate 10 has a frame in the form of a basket 14 which is supported on a base formed of a plurality of legs 16. In accordance with the persent invention, mounted on the basket 14 are a pair of guard fixtures 18, whose structure and function will be more fully hereinafter described.

The basket 14 is formed of first and second sets of parallel, spaced rib members 20 and 22. The first set of rib members 20 extend laterally between the sides of the grate 10 in spaced relation to one another. The second set of rib members 22 extend between the front and back of the grate 10 in spaced relation to one another. Each rib member is characterized by a central segment as exemplified by 24, and upturned end segments as exemplified by 26*a* and 26*b*. The grid defined by the central segments of the first and second sets of rib members 20 and 22 forms a wood receiving bed 28. The upturned ends of the first set of rib members 20 defined laterally opposed side walls 30 and 32. The upturned end segments of the second set of rib members 22 define front and rear walls 34 and 36. The extreme ends of the first and second sets of rib members 20 and 22 are conjoined by a brim 38.

Figure 2:
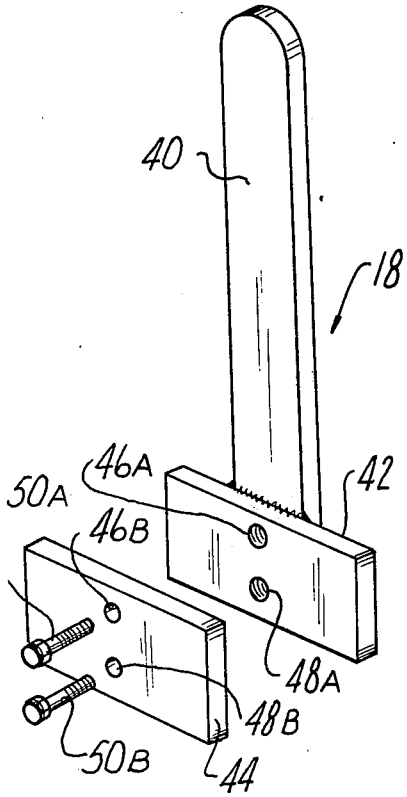
FIG. 2 is an exploded isometric view of a guard fixture consturcted in accordance with the present invention.

The guard fixture 18 shown mounted on the fireplace grate 10 in FIG. 1, is illustrated broken down into its constituent parts in FIG. 2.

The grate fixture 18 is formed of a rigid, metallic material, such as steel, aluminum or the like, that is able to withstand the temperatures assoicated with combustion. It includes an elongate post 40 which has appurtenant to its bottom end means for affixing the post to the basket 14. In the preferred embodiment, these means include first and second flange plates 42 and 44, each of which is adapted to abut an opposed surface of a pair of adjacent rib members 22. The first and second flange plates 42 and 44 must each have a width greater than the space between an adjacent pair of rib members 22. The first flange plate 42 is fixedly secured to the bottom of the post 40 by welding or similar means. As would be apparent to one skilled in the art, in an alternative embodiment, the first flange plate 42 may be substituted for by broadening the bottom end of the post 40 to form an integral flange which serves the same function as the first flange plate. A pair of threaded bores 46*a* and 48*a* are common to flange plate 42 and post 40 and pass through their surface of joinder. The second flange plate 44 also has two bores 46*b* and 48*b* which pass therethrough and register with bores 46*a* and 46*b*. A pair of threaded bolts 50*a* and *b* are adapted to pass through bores 46*b* and 48*b* in flange plate 44 and engage with threaded bores 46*a* and 48*a* in the bottom of post 40 and flange plate 42.

The design of the guard fixture 18 may be modified from the above described form aesthetic purposes. For example, the post 40 may be cast in a stylized form to give it an ornamental apperance. Also, the entire guard fixture 18 may be surface treated, as for example with a black nitrided finish, to cause it to conform to the appearance of the grate to which it is attached.

Figure 3:
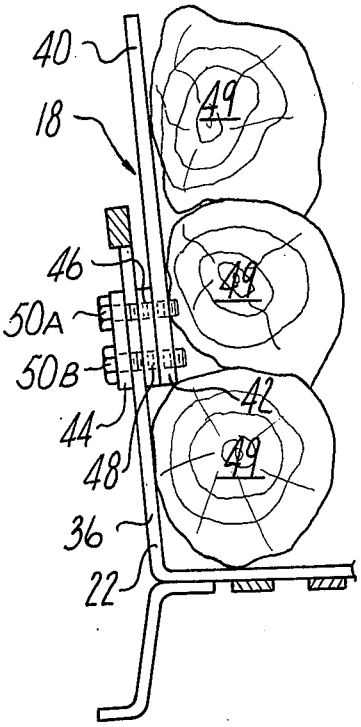
FIG. 3 is a sectional view taken along line 3—3 of FIG. 1 illustrating the manner in which the guard fixture is mounted on the grate.

The manner in which the guard fixture 18 is mounted on the basket 14 is shown most clearly in FIG. 3. The post 40 and flange plate 42 are positioned on the inside of the front wall 36 such that the flange plate 42 abuts the inner surface. The second flange plate 44 is positioned on the outside of the front wall 36 directly opposite the first flange plate 42. The threaded bolts 50*a* and *b* pass through bores 46 and 48, respectively, which are aligned with the space between adjacent rib members 22, to mechanically couple the guard fixture 18 to the front wall 36 of the basket 14. As previously indicated, by requiring that the width of each of the flange plates 42 and 44 be greater than the space between adjacent rib members, there is assured a secure mounting of the guard fixture 18, irrespective of the width of the post 40.

When mounted in the manner shown in FIG. 3, the guard fixture 18 positively restrains logs 49 from rolling out of the grate 10, as they are inclined to do when loaded beyond the capacity of the grate.

Figure 4:
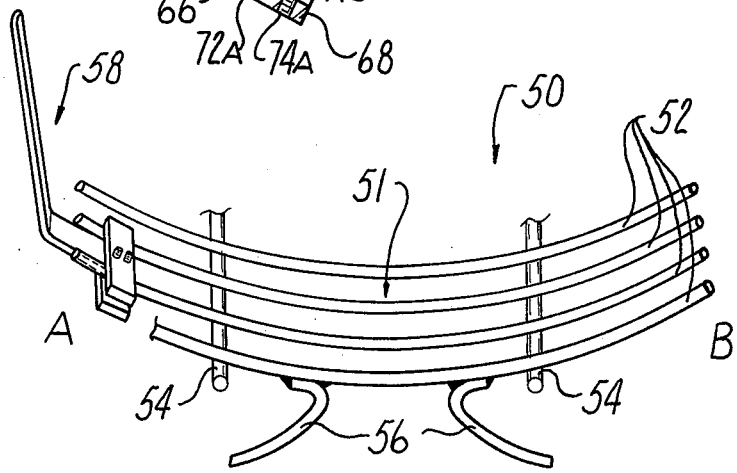
FIG. 4 is an alternative embodiment of the guard fixture of the present invention, showing it adapted for use with a dish-shaped grate; and, FIG. 5 is an exploded isometric view, showing in section the guard fixture of FIG. 4.

A second embodiment of the invention for use in connection with another popular type of fireplace grate is shown in FIG. 4.

In this embodiment, a dish-shaped grate 50 has a concave frame 51 formed of a plurality of parallel, spaced, curvilinear rib members 52 which extend between the front A and the back B of the grate. The rib members 52 ae affixed to a pair of cross braces 54 that hold them in spaced relation to one another. A set of leg members 56 are in supportive positions under the extreme rib members 52 to provide a base. Mounted on the front end A of the grate 50 is a guard fixture 58 whose construction is modified from that of guard fixture 18 of FIG. 2 in order to adapt to the specific configuration of the frame 51.

Figure 5:
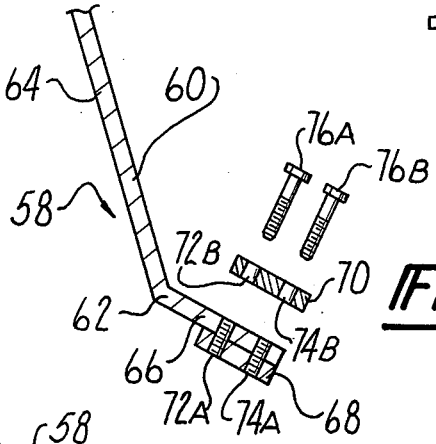

The guard fixture 58 illustrated in FIG. 4, is shown broken down into its constituent parts in FIG. 5.

The guard fixtrue 58 includes a elongate post 60 which has a bend 62 mediate its upper and lower ends that divides the post into an upper segment 64 and a lower segment 66. The upper segment 64, being formed at an angle with respect to the lower segment 66, projects substantially vertically with respect to the frame 51. The lower segment 66 has appended to it means for securing the post to a pair of adjacent curvilinear rib members 52. These means include first and second flange plates 68 and 70. The first flange plate 68 is affixed to the bottom segment 66. A pair of threaded bores 72*a* and 74*a* are common to bottom segment 66 and flange plate 68 and pass through their plane of joinder. The second flange plate 70 likewise has a pair of bores 72*b* and 74*b* which register with bores 72*a* and 74*a*. A pair of threaded bolts 76*a* and 76*b*, are adapted to pass through bores 72*b* and 74*b* and engage with threaded bores 72*a* and 74*a*. When asembled in this manner, the guard fixture 58 may be mounted on the dish-shaped grate 50 in the manner illustrated in FIG. 4, which is directly analogous to the manner in which guard fixture 18 is mounted to grate 10, as previously discussed in connection wth FIG. 3.

As can be seen from the foregoing, the guard fixture of the present invention is generally adaptable to fireplace grates which have a frame formed of a plurality of fore and aft extending rib members. The two embodiments in which the invention has been illustrated, are thus, not intended to be limiting, but only indicative of its broad scope of applicability. Alternative embodiments will suggest themselves to those having skill in the art without departing from the scope of the present invention.

The embodiments of the invention in which an exclusive property or privilege is claimed are defined as follows:

1. For use in combination with a fireplace grate of the type having a frame formed of a plurality of spaced, substantially parallel rib members which extend fore and aft when placed in a fireplace opening and in application are supportive of a plurality of logs arranged in a stacked reltionship, said ribs being substantially perpendicular to the axes of extension of said logs, a guard fixture comprising: an elongate post of substantially greater length than width; a first flange plate integrally fixed to the elongate post at one end thereof and of greater width than said post; a second flange plate separate from said post and of greater width than said post, the first and second flange means each being of width greater than the spacing between adjacent rib members, and adapted to abut opposed sides of a pair of adjacent rib members; and fastener means extending between the flange plates for fastening the first and second flange plates in abutting relation with the pair of adjacent rib members whereby said post is affixed to the frame so as to cause it to project substantially upwardly with respect to the frame, the vertical height of said post substantially exceeding the height of said grate, the portion of said post that exceeds the height of said grate being operative to prevent logs within said stack from rolling forwardly out of said grate.

2. The guard fixture as defined in claim 1 wherein the fastener means include at least one threaded fastener adapted to engage with aligned bores through the elongate post and the first and second flange plates.

3. The guard fixture as defined in claim 1 wherein the elongate post has a bend mediate its upper and lower ends.

* * * * *